United States Patent [19]
Johnston
[11] 4,234,665
[45] Nov. 18, 1980

[54] OIL-BORNE CREOSOTE AND PENTACHLOROPHENOL WOOD PRESERVATIVE COMPOSITIONS CONTAINING DIMETHYLAMIDE

[75] Inventor: Titus M. Johnston, Nesbit, Miss.

[73] Assignee: Buckman Laboratories, Inc., Memphis, Tenn.

[21] Appl. No.: 85,567

[22] Filed: Oct. 17, 1979

[51] Int. Cl.³ ..... B05D 1/18; B18K 3/40
[52] U.S. Cl. ..... 428/541; 106/18.32; 106/18.35; 252/404; 252/405; 427/441; 428/907
[58] Field of Search ..... 427/440, 441; 252/384, 252/404, 405; 428/907, 541; 106/18.32, 18.35

[56] References Cited

U.S. PATENT DOCUMENTS

| | | | |
|---|---|---|---|
| 1,967,990 | 7/1934 | Edwards | 427/441 X |
| 2,799,597 | 7/1957 | Walker et al. | 427/441 X |
| 3,061,508 | 10/1962 | Morriss et al. | 427/441 X |
| 3,539,289 | 11/1970 | Suzuki et al. | 428/541 |

*Primary Examiner*—Michael R. Lusignan
*Attorney, Agent, or Firm*—Floyd Trimble

[57] ABSTRACT

The penetration properties of creosote and pentachlorophenol oil-borne wood preservative compositions are improved by adding to such compositions an N,N-dimethylamide of a carboxylic acid containing 18 carbon atoms and at least 1 carbon to carbon double bond.

11 Claims, No Drawings

OIL-BORNE CREOSOTE AND PENTACHLOROPHENOL WOOD PRESERVATIVE COMPOSITIONS CONTAINING DIMETHYLAMIDE

This invention relates to the treatment of wood and similar materials to control the growth of bacteria and fungi in and on the surfaces of such materials. More particularly, this invention relates to a method of increasing the wood penetrating properties of oil-borne creosote and pentachlorophenol wood preservative compositions by adding thereto a N,N-dimethylamide of a carboxylic acid containing 18 carbon atoms and at least 1 carbon to carbon double bond.

Wood products are normally susceptible to bacteria and fungal degradation if means are not taken to inhibit the growth of these microorganisms that cause such degradation which is generally evident as decay, soft rot, sapstain (blue stain) and the formation of mold on the wood. These results are not only objectionable aesthetically, but the ultimate result is the structural failure of the wood.

Many compositions broadly defined as oil-borne preservatives and water-borne salts have been suggested for use as wood preservatives. Of these, the oil-borne preservatives, specifically creosote and pentachlorophenol, have been the most widely used even though they have not been entirely satisfactory. As, for example, the wood penetration properties of these two oil-borne wood preservation compositions are insufficient for some uses even when the wood treatment process is conducted at elevated temperatures and pressures. In general, for all uses the extent of penetration and retention of the preservative into the wood and its effectiveness as a perservative vary directly.

It is, therefore, a principal object of the present invention to provide a composition and process for the control of bacteria and fungi in and on wood products which obviates the disadvantages of the prior art.

It is another object of this invention to provide a composition having high wood penetrating properties.

It is yet another object of my invention to provide a composition and process for the control of bacteria and fungi in and on the surface of wood which shall have a high degree of effectiveness over a wide range of concentrations and physical environments.

These and other objects and advantages of the processes and compositions will become apparent as the description proceeds.

To the accomplishment of the foregoing and related ends, this invention then comprises the features hereinafter fully described and particularly pointed out in the claims, the following description setting forth in detail certain illustrative embodiments of the invention, these being indicative, however, of but a few of the various ways in which the principles of the invention may be employed.

Briefly stated, I have discovered that the addition of a relatively small amount of a N,N-dimethylamide of a straight chain unsaturated carboxylic acid to the wood preservative is very effective in increasing the penetrative properties of the wood preservative.

Suitable N,N-dimethylamides of straight chain carboxylic acids are those prepared from carboxylic acids containing 18 carbon atoms and further characterized by having at least one carbon to carbon double bond. Specific acids classified within this category include:

linoleic, linolenic, oleic, ricinoleic, and mixtures thereof. The N,N-dimethylamides of the foregoing acids are identified as N,N-dimethyllinoleamide, N,N-dimethyllinolenamide, N,N-dimethyloleamide, and N,N-dimethylricinoleamide, respectively. Also, suitable are the mixed acids found in tall, castor, corn, cottonseed, linseed, olive, peanut, rapeseed, safflower, sesame, and soybean oils. A mixture of carboxylic acids particularly suitable for use in our invention is that available commercially as tall oil fatty acids under the trademark Unitol ACD Special. A typical analysis of this product is as follows:

| | Typical analysis |
|---|---|
| Fatty acids, pct | 97.5 |
| Rosin acids, pct | 1.0 |
| Unsaponifiables, pct | 1.5 |
| Linoleic acid, pct | 45.1 |
| Oleic acid, pct | 49.5 |
| Saturated acid, pct | 1.6 |
| Acid number | 195 |
| Saponification number | 197 |
| Color, Gardner | 3 |
| Specific gravity, 25° C./25° | 0.902 |
| Titre, °C. | 2.0 |
| Flash point, °F. | 380 |
| Firepoint, °F. | 423 |

The N,N-dimethylamides of these tall oil fatty acids will sometimes hereinafter be referred to as DMA.

When the N,N-dimethylamide is used as a penetrant for wood preservatives, it is added at the desired concentrations to the preservative as part of the fomulation prior to treating the wood. As to the amount of the N,N-dimethylamide to be added to the formulation, that may vary from about 100 to about 5,000 parts per million parts of preservative solution with the preferred range varying from about 250 to 2000 parts per million parts of preservative solution. It will be understood, of course, that larger quantities of the N,N-dimethylamide may be used, but such increased quantities increase the cost of operation without materially increasing the overall efficiency of the operation.

Some of the desirable results obtainable by following the teachings of my invention as compared to the use of the oil-borne wood preservative without the N,N-dimethylamide may be summarized as follows:

1. Decrease in the amount of time and labor required to obtain adequate preservative penetration
2. Increased turnover of wood inventories or a result of less treating time
3. Decreased amounts of energy, both terminal and electrical to treat wood
4. Increase in overall plant efficiency
5. Reduced production costs
6. Increased production per unit of equipment In order to disclose the nature of the present invention still more clearly, the following illustrative examples will be given. It is to be understood that the invention is not to be limited to the specific conditions as details set forth in these examples except insofar as such limitations are specified in the appended claims. In the example wherein the DMA is listed as p.p.m., this is meant as parts DMA per million parts of the oil-borne wood preservative composition.

EXAMPLE 1

A stock solution of 4500 p.p.m. of DMA in a standard commercial oil based creosote wood preservative was prepared. Enough of this solution was placed in a 10 gallon treatment cylinder to completely submerge the wood to be treated. This solution was then heated in the cylinder to 200° F. in a steam bath. Blocks of Douglas fir 3½"×3½"×18" were submerged in this solution and a pressure of 125 psi was applied. After a total treatment time of three hours, the treated blocks were removed. Upon removal, a wafer cross section (¼" thick) was cut from the center of the test blocks. Penetration was determined by measuring the total square inches penetrated. Results are presented in Table 1.

TABLE 1

| Creosote Alone | | | Creosote + DMA | | |
|---|---|---|---|---|---|
| Block Number | Sq. Inches Penetrated | Percent Penetration | Block Number | Sq. Inches Penetrated | Percent Penetration |
| 1-3 | 4.81 | 40.0 | 1-4 | 5.21 | 44.0 |
| 1-7 | 3.59 | 39.0 | 1-8 | 3.97 | 34.0 |
| 2-2 | 5.18 | 44.0 | 2-1 | 6.72 | 58.0 |
| 2-9 | 4.37 | 39.0 | 2-7 | 5.92 | 51.0 |
| 3-6 | 7.77 | 65.0 | 3-2 | 7.53 | 63.0 |
| 4-4 | 5.60 | 48.0 | 3-5 | 7.50 | 64.0 |
| 4-5 | 7.45 | 65.0 | 4-3 | 7.15 | 62.0 |
| 5-1 | 6.29 | 54.0 | 4-6 | 7.87 | 67.0 |
| 5-5 | 7.80 | 69.0 | 5-2 | 9.54 | 83.0 |
| 3-1 | 7.81 | 66.0 | 5-6 | 8.97 | 79.0 |
| Means | 6.07 | 51.9 | Means | 7.02 | 60.5 |

DMA plus creosote gave a 16.6% increase in penetration over creosote alone.

Similar results were obtained following the experimental procedure of Example 1 when the specific N,N-dimethylamide, N,N-dimethyllinoleamide, N,N-dimethyllinolenamide, N,N-dimethyloleamide, and N,N-dimethylricinoleamide, were individually substituted for DMA. In addition, similar results were also obtained when the individual mixtures of N,N-dimethylamides prepared from the mixed acids found in castor, corn, cottonseed, linseed, olive, peanut, rapeseed, safflower, sesame, and soybean oils using the same experimental procedure were substituted for DMA.

EXAMPLE 2

The same materials and methods were used in this test as in Example 1 except a standard 5% pentachlorophenol preservative was used. Results are presented in Table II.

TABLE II

| Pentachlorophenol Alone | | | Pentachlorophenol + DMA | | |
|---|---|---|---|---|---|
| Block Number | Sq. Inches Penetrated | Percent Penetration | Block Number | Sq. Inches Penetrated | Percent Penetration |
| 1-1 | 4.14 | 35.0 | 1-2 | 5.85 | 48.0 |
| 1-5 | 4.54 | 39.0 | 1-6 | 5.38 | 46.0 |
| 2-3 | 7.42 | 63.0 | 2-4 | 6.49 | 55.0 |
| 2-6 | 7.43 | 64.0 | 2-5 | 7.48 | 64.0 |
| 3-4 | 7.99 | 68.0 | 3-3 | 8.81 | 76.0 |
| 3-7 | 8.36 | 72.0 | 3-8 | 9.96 | 83.0 |
| 4-2 | 7.84 | 66.0 | 4-1 | 10.66 | 92.0 |
| 4-8 | 8.20 | 71.0 | 4-8 | 10.45 | 89.0 |
| Means | 7.62 | 59.7 | Means | 8.14 | 69.1 |

DMA plus pentachlorophenol gave a 16.7% increase in penetration over pentachlorophenol alone.

EXAMPLE 3

Stock solutions of 1890 and 3780 p.p.m. of DMA in a standard commercial oil based creosote wood preservative were prepared. Enough of these test solutions were placed in a 10 gallon autoclave to completely submerge the wooden test blocks to be treated. The test solutions were heated in the autoclave to 200° F. Blocks of southern pine 3½"×3½"×18" were submerged in these solutions and a pressure of 200 psi was applied. After a treatment time of one hour, the treated blocks were removed. Upon removal, a wafer cross section ¼" thick was cut from the center of the test blocks. Penetration was determined by measuring the total square inches penetrated. Results are presented in Table III.

TABLE III

| DMA p.p.m. In Creosote | Pressure | Temperature | Time | Penetration[1] |
|---|---|---|---|---|
| 0 | 200 psi | 200° F. | 1 hr. | 86.5% |
| 1890 | 200 psi | 200° F. | 1 hr. | 98.5% |
| 3780 | 200 psi | 200° F. | 1 hr. | 97.8% |

[1]Average penetration obtained from eight replications.

EXAMPLE 4

A stock solution of 4500 p.p.m. of DMA in a standard 5% commercial oil based pentachlorophenol wood preservative was prepared. Enough of this test solution was placed in a 10 gallon autoclave to completely submerge the wood test blocks. The test resolutions were heated in an autoclave to 200° F. Blocks of Douglas fir 2½"×3½"×18" were submerged in this solution and pressure of 130 psi was applied. After a treatment time of 30 minutes the treated blocks were removed. Upon removal, a wafer cross section ¼" thick was cut from the center of the test blocks. Penetration and retention were determined by measuring the total square inches penetrated and uptake of the test solution. Results are presented in Table IV.

TABLE IV

| DMA p.p.m. In PCP | Percent[1] Penetration | Retention[1] lb/cu ft |
|---|---|---|
| 0 | 45 | 7.2 |
| 4500 | 67 | 7.6 |

[1]Average percent penetration and retention were determined from eight replications.

Under some conditions it may be desirable to add a nonionic surface active agent to the N,N-dimethylamide to increase the miscibility of the latter in water. When this optional procedure is followed, we have found that a suitable weight ratio of the surface active agent to the N,N-dimethylamide is about 1 to about 9.

While particular embodiments of the invention have been described, it will be understood, of course, that the invention is not limited thereto since many modifications may be made; and it is, therefore, contemplated to cover by the appended claims any such modifications as fall within the spirit and scope of the invention.

The invention having thus been described, what is claimed and desired to be secured by Letters Patent is:

1. In a process for the treatment of wood with a wood preservative composition selected from the group consisting of oil-borne creosote and oil-borne pentachlorophenol compositions to inhibit the growth and proliferation of bacteria and fungi in and on the surface of the wood, the improvement which comprises the addition to said wood preservative composition of a N,N-dimethylamide of a carboxylic acid containing 18 carbon atoms and at least 1 carbon to carbon double bond in an amount sufficient to increase the wood penetrative properties of said preservative composition.

2. The method of claim 1 wherein the straight chain carboxylic acid is linoleic acid.

3. The method of claim 1 wherein the straight chain carboxylic acid is linolenic acid.

4. The method of claim 1 wherein the straight chain carboxylic acid is oleic acid.

5. The method of claim 1 wherein the straight chain carboxylic acid is ricinoleic acid.

6. The method of claim 1 wherein the straight chain carboxylic acid is a mixture of acids derived from tall oil.

7. The method of claim 1 wherein the straight chain carboxylic acid is a mixture of acids derived from linseed oil.

8. The method of claim 1 wherein the straight chain carboxylic acid is a mixture of acids derived from soybean oil.

9. The method of claim 1 wherein the straight chain carboxylic acid is a mixture of acids derived from cottonseed oil.

10. The method of claim 1 wherein the straight chain carboxylic acid is a mixture of acids derived from corn oil.

11. The method of claim 1 wherein the straight chain carboxylic acid is a mixture of acids derived from peanut oil.

* * * * *